US011554464B2

(12) United States Patent
Chepurny

(10) Patent No.: US 11,554,464 B2
(45) Date of Patent: Jan. 17, 2023

(54) WORK MATERIAL CLAMP FOR USE WITH CUTTING MACHINES

(71) Applicant: Mark P. Chepurny, Bradford (CA)

(72) Inventor: Mark P. Chepurny, Bradford (CA)

( * ) Notice: Subject to any disclaimer, the term of this patent is extended or adjusted under 35 U.S.C. 154(b) by 103 days.

(21) Appl. No.: 16/213,693

(22) Filed: Dec. 7, 2018

(65) Prior Publication Data

US 2020/0180118 A1 Jun. 11, 2020

(51) Int. Cl.

| | |
|---|---|
| ***B25B 5/16*** | (2006.01) |
| ***B25B 5/10*** | (2006.01) |
| ***B25B 5/00*** | (2006.01) |
| ***B25B 5/14*** | (2006.01) |

(52) U.S. Cl.

CPC ..... *B25B 5/163* (2013.01); *B25B 5/006* (2013.01); *B25B 5/102* (2013.01); *B25B 5/108* (2013.01); *B25B 5/145* (2013.01); *B25B 5/166* (2013.01)

(58) Field of Classification Search

CPC ..... B25B 5/006; B25B 5/102; B25B 5/104; B25B 5/105; B25B 5/107; B25B 5/145; B25B 5/163; B25B 5/166

USPC ..... 269/262, 231, 303, 317

See application file for complete search history.

(56) References Cited

U.S. PATENT DOCUMENTS 1,255,729 A * 2/1918 Force ..... B25B 5/106 269/93
2,061,718 A * 11/1936 Stahl ..... B25B 5/105 269/232
4,157,819 A * 6/1979 Meyer ..... B25B 5/08 269/231
4,335,873 A * 6/1982 Kiefer ..... B25B 5/163 269/228
4,836,519 A * 6/1989 Duncan ..... B25B 5/106 269/254 R
4,915,367 A * 4/1990 Carossino ..... B25B 1/08 269/101
5,586,754 A * 12/1996 Williams ..... B25B 5/10 269/99
5,644,964 A * 7/1997 Price ..... B23Q 1/74 269/254 R
5,836,574 A * 11/1998 Park ..... B25B 5/107 269/93
6,435,496 B1 * 8/2002 Phillips ..... B25B 5/08 269/138
10,179,393 B2 * 1/2019 Hull ..... B25B 1/2405
2003/0051592 A1 * 3/2003 Molburg ..... B27B 9/04 83/745
2006/0145406 A1 * 7/2006 Iwata ..... B25B 5/062 269/233
2014/0090211 A1 * 4/2014 Kalman ..... F16B 2/10 29/525.08

(Continued)

*Primary Examiner* — Lee D Wilson
*Assistant Examiner* — Aaron R McConnell
(74) *Attorney, Agent, or Firm* — Christensen, Fonder, Dardi & Herbert, PLLC

(57) ABSTRACT

A clamp for use with a cutting machine, the clamp comprising: a clamp frame; a low profile clamp head operatively connected to the clamp frame, wherein the clamp head has a clamping surface for pressing on a work surface of a work piece to hold said work piece; and a fixing element, operatively connectable to the clamp frame, for providing a clamping force to the clamp head by fixing the clamp to a support base for the work piece. In embodiments, the clamp head may have a low profile clamp head, made of plastic to prevent damage to a cutting bit.

19 Claims, 5 Drawing Sheets

(56) References Cited

U.S. PATENT DOCUMENTS

2015/0129573 A1* 5/2015 Traver ..... B23K 9/12
219/138

* cited by examiner

WORK MATERIAL CLAMP FOR USE WITH CUTTING MACHINES

FIELD OF THE INVENTION

This invention relates to the field of cutting machines, and in particular, to accessories cutting machines.

BACKGROUND OF THE INVENTION

There are a variety of cutting machines commonly in use. Among them are lathes, mills, routers and grinders. More recently, CNC (Computer Numerical Control) machines, which are computer controlled for high precision have recently risen in popularity. Such machines typically operate continuously, relying on the computer control. Such machines, and other machines, involve a bit or other cutting tool cutting repeatedly into a work piece.

It is typical for the work piece to be clamped in place to permit precision cutting of the work piece. The work piece is, in the example of CNC machines, typically clamped to a wasteboard. A wasteboard is a piece of material under the work piece, to which the work piece is clamped, which may be incidentally cut during cutting of the workpiece. It will be appreciated, however, that the work piece may be clamped in other configurations, to other kinds of support bases.

Two typical kinds of wasteboards are threaded insert wasteboards, and T-track wasteboards. Both kinds of wasteboards are configured to facilitate attachment of clamps to the wasteboards, to provide the clamping force for holding the workpiece on the wasteboard. In the most typical configuration, a clamp is fixed to the wasteboard, and the clamp presses down on the work piece to hold it in a fixed position on the wasteboard.

One problem that sometimes arises with such clamps is that the user misjudges the position of some of the cuts to the workpiece, with the result that the machine bit cuts into the clamp, thus damaging the bit.

SUMMARY

What is desired is a clamp that ameliorates or reduces one or more deficiencies of at least some prior art clamps.

Therefore, according to an aspect of the present invention there is provided a clamp for use with a cutting machine, the clamp comprising: a clamp frame; a clamp head operatively connected to the clamp frame; and a fixing element, operatively connectable to the clamp frame, for providing a clamping force to a work piece by fixing the clamp to a support base; wherein the clamp head is composed of plastic to prevent damage to cutting bits contacting the clamp head. Optionally, the clamp frame comprises a pair of metal pins, and a frame stiffening element connecting the two pins. Optionally, the fixing element comprises a screw, and the support base comprises a threaded insert wasteboard. Optionally, the clamp further comprising a lever operatively coupled to the fixing element for actuating the fixing element. Optionally, the support base comprises a T-track wasteboard, and the fixing element comprises a nut for attaching to a screw that is attached to the T-track wasteboard.

According to another aspect of the invention, there is provided a clamp for use with a cutting machine, the clamp comprising: a clamp frame; a clamp head operatively connected to the clamp frame; and a fixing element, operatively connectable to the clamp frame, for providing a clamping force to a work piece by fixing the clamp to a support base; wherein the clamp head is operatively attachable to and detachable from the clamp frame by hand. Optionally, there is provided a clamp kit comprising this clamp, and a second clamp head, operatively connectable to the clamp frame, for replacing said clamp head. Optionally, the frame comprises a pair of metal pins, and wherein the clamp head is slidable on to and off of the pins. Optionally, the clamp head is composed of plastic.

According to another aspect of the invention, there is provided a clamp for use with a cutting machine, the clamp comprising: a clamp frame; a clamp head operatively connected to the clamp frame, the clamp head having a clamping surface for pressing on a work surface of a work piece to hold said work piece; and a fixing element, operatively connectable to the clamp frame, for providing a clamping force to the clamp head by fixing the clamp to a support base for the work piece; wherein the clamp head is a low profile clamp head. Optionally, the clamp head extends less than 2 centimetres above the work surface. Optionally, the clamp head extends less than one centimetres above the work surface. Optionally, the clamp frame has a profile no higher than the clamp head.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
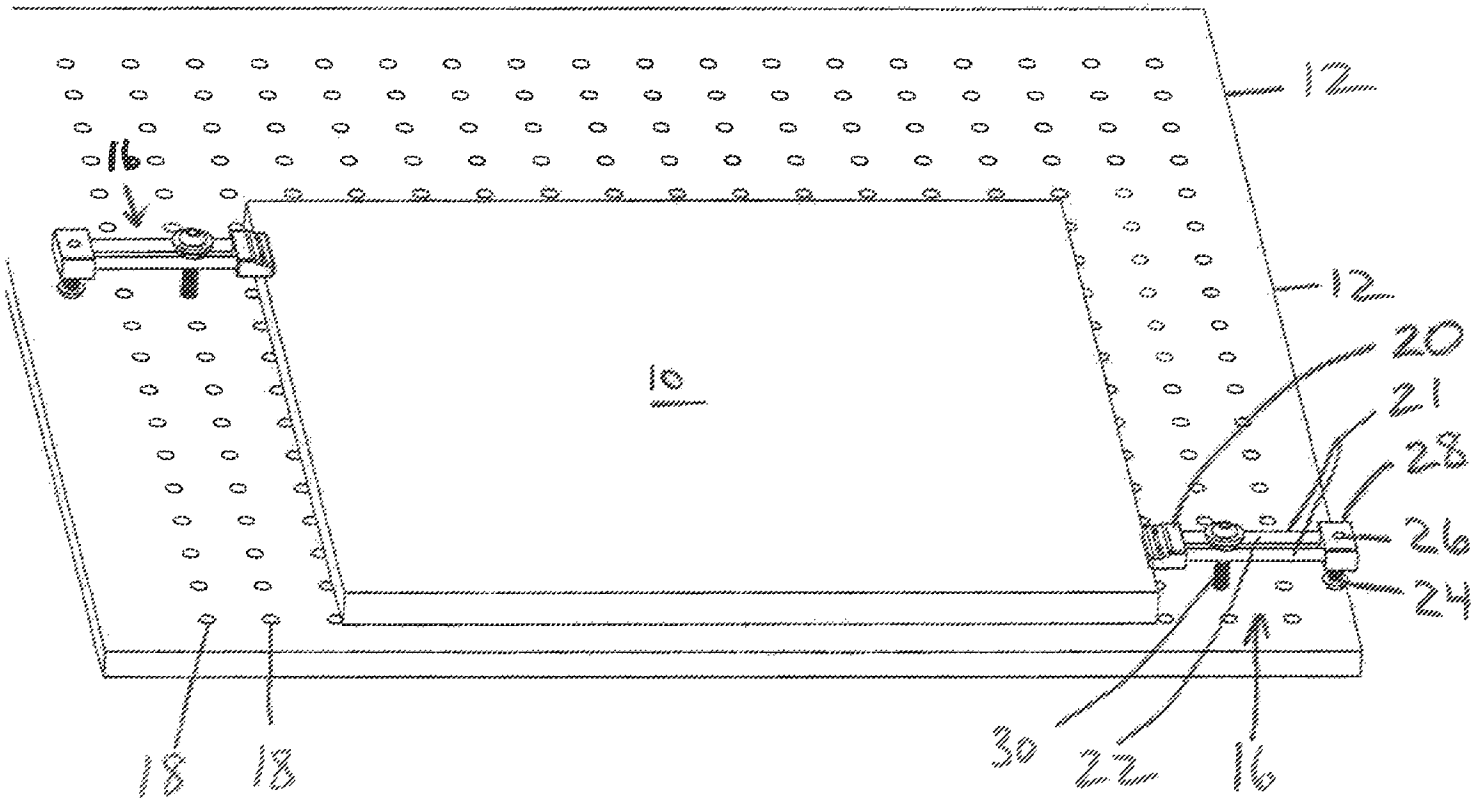
FIG. 1 shows a top perspective view of clamps in use with a support piece and work piece in accordance with an embodiment of the invention.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

The invention will be described in detail with reference to a CNC mill/router. It will be appreciated that the invention is not limited to such a router. The invention is applicable mutatis mutandis to other cutting machines.

Referring now to FIG. 1, a support piece for a work piece, in the form of a waste board 12 is shown. The waste board 12 is positioned to support a workpiece 10. The workpiece 10 is positioned to facilitate work on the workpiece 10 by a cutting tool (not shown) associated with a CNC machine (not shown).

The waste board 12 shown in FIG. 1 is a threaded insert waste board. Numerous threaded inserts 18 are shown on the waste board 12. In the example waste board shown in FIG. 1, threaded inserts 18 are provided in a grid pattern to provide a wide variety of clamping locations.

Two clamps 16 are shown in FIG. 1. As will be described in greater detail below, clamps 16 are holding work material 10 on the waste board 12. The clamping force used by clamps 16 is provided by attachment of clamps 16 to the waste board 12.

In the example shown in FIG. 1, the clamps 16 are attached to waste board 12 by a fixing element, in the form of a screw being screwed into a threaded insert 18 in waste board 12. However, it will be appreciated that the invention also comprehends use of a T-track waste board 12. In T-track waste board 12, the attachment would be by means of a screw extending out of the waste board with its head positioned inside the T track, and a nut fixing the clamp 16 to that screw, thus fixing the clamp to the waste board 12.

Figure 2:
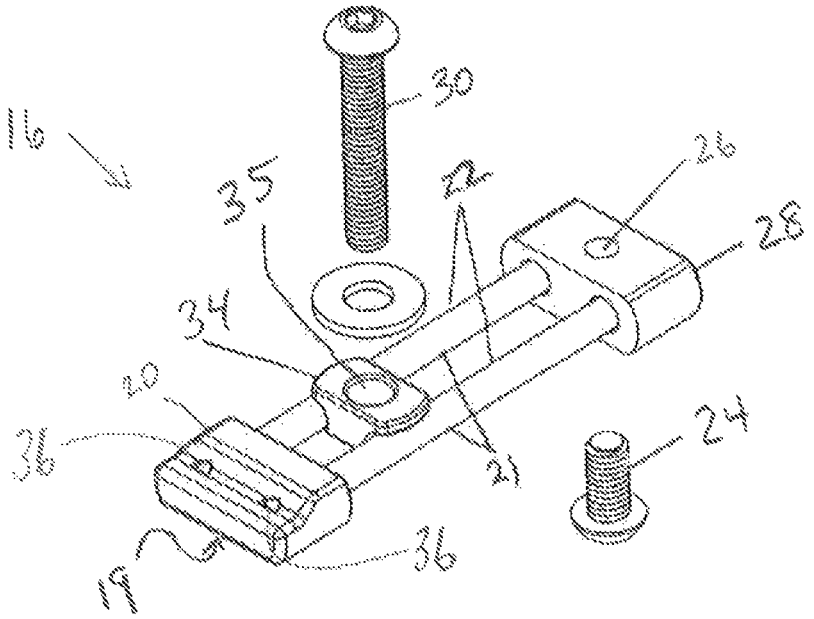
FIG. 2 is a perspective partially exploded view of an embodiment of the clamp.
Figure 3:
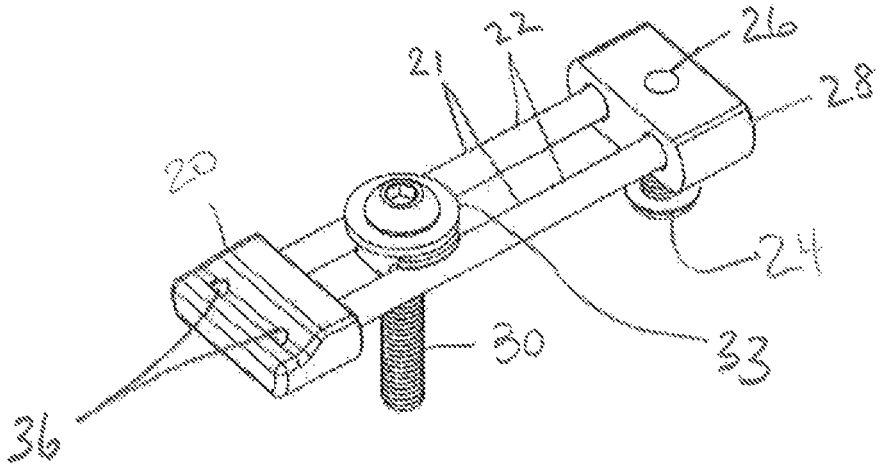
FIG. 3 is a perspective view of an embodiment of the clamp.

Referring now to FIGS. 2 and 3, the example clamp 16 comprises a clamping head 20 having clamping surface 19, a clamp frame 22, and a height adjustment assembly. In FIGS. 2 and 3, the height adjustment assembly comprises a jack screw 24 and a screw receiving socket 26 within frame stiffening end piece 28.

The clamp 16 further comprises a fixing element. In the embodiment of FIGS. 2-3, the fixing element comprises a screw 30, with washer 33, configured to fix the clamp 16 in position against the waste board 12. Clamp 16 of FIGS. 2-3 comprises a selectively positionable socket 34. As shown in these figures, socket 34 includes through-hole 35 for receiving the screw 30. Socket 34 fits into frame 22, and is slidable along frame 22 to facilitate adjustment of the position of screw 30. Preferably, socket 34 fits with a snap fit onto and between pins 21, so that it remains attached to them while being slidable along the frame 22. Socket 34 is configured to transmit the clamping force from screw 30 to frame 22, which is turn transmits clamping force to clamping head 20 to press on work piece 10 to hold it in place.

It will be appreciated that the socket 34 being selectively positionable is helpful because there are a limited number of threaded inserts, meaning that there are a limited number of points of connection to the waste board 12. The position of the screw 30 therefore may need to be adjusted.

It will further be appreciated that the invention comprehends the absence of a socket 34. Screw 30 and frame 22 may be sized, shaped and mutually configured so that screw 30 acts directly on frame 22 to provide clamping force to clamp 16. Other configurations of fixing element are also comprehended.

In the preferred embodiment, the frame 22 comprises a pair of spaced metal pins 21. Preferably, the metal comprises alloy steel, or stainless steel. It will be appreciated that, since the frame 22 transmits clamping force from the fixing element to the clamping head 20, and since it is desirable to provide high clamping force, it is therefore also preferred that frame 22 to be made of the material capable of withstanding a high clamping force without bending or otherwise failing. In some embodiments, pins 21 are inserted into receiving holes in a frame stiffening element, to provide a stiff frame for receiving and transmitting clamping force.

It will be appreciated that, in use, clamping head 20 is typically positioned on the surface of workpiece 10 that is being engaged by the cutting tool. In particular, clamping surface 19 typically presses against that surface of the work piece. As such, if the path of the cutting tool is misjudged by the user, the cutting tool may cut into clamp 16, and most likely, clamping head 20. In the prior art, such a collision between the cutting tool and the clamp might lead to the cutting tool being seriously damaged. Specifically, in the prior art, clamps and clamping heads are made of metal. Thus, when the cutting tool contacts a mental clamp, it is often damaged beyond repair.

However, in the preferred embodiment, clamping head 20 is made of plastic. Thus, if the cutting tool contacts the clamping head 20 of the preferred embodiment, it is much more likely not to be damaged. The reason is that the cutting tool, generally made of metal, can generally cut into the plastic without being damaged by it. It will be appreciated, however, that other materials besides plastic are comprehended. Less preferably, a hard material such as metal may still be used. More preferably, a non-plastic material may be used which, like plastic, is soft enough not to damage the cutting tool when the cutting tool cuts into it.

In the preferred embodiment, the head 20 includes space for receiving frame 22. In the preferred embodiment, this receiving space comprises two slots, each of which receives a pin 21 of frame 22. Preferably, the slots extend only part way into the clamping head 20, so that the forward portion of the clamping head 20, beyond the pins 21, can clamp the workpiece, while the pins 21 of frame 22 are positioned off of the workpiece. This lessens the probability that the cutting tool would make contact with the pins of frame 22. As can be seen in FIG. 2, the preferred clamping head 20 has viewing holes 36 that show externally the ends of the pins 21. Using these holes, the user can position the head 20 so that it clamps on to the work piece, while the frame 22, including the pins 21, are positioned off the work piece, and not positioned at, on or above the work piece.

Figure 6:
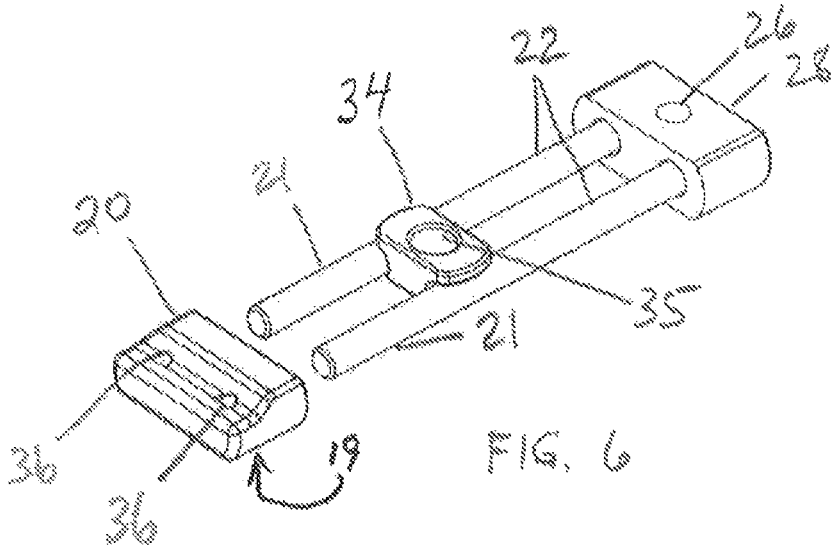
FIG. 6 is a perspective partially exploded view of an embodiment of the clamp.

Referring inter alia to FIG. 6, preferably, the clamp head 20 is slidable on to and off of the pins 21 comprising frame 22. Clamp head 20 preferably fits on to pins 21 by a friction fit or pressure fit. Thus, clamp head 20 can be replaced with a new clamp head 20, which is beneficial if clamp head 20 is damaged by contact with the cutting tool; under these circumstances, damaged clamp head 20 can be pulled off frame 22 by hand, and new clamp head 20 can be slid on to frame 22. In this regard, the clamp of the present invention may provided in a kit, with the kit containing the clamp, and at least a second clamp head 20 as a replacement.

It will be appreciated that other modes of attachment of clamp head 20 to frame 22 are comprehended by the invention. Less preferred is a form of attachment and detachment that does not permit easy replacement of head 20. More preferable is any form of attachment and detachment permitting the clamp head to be pulled off and pushed on solely by hand, without requiring cutting, breaking, heating, or any other process not done solely by hand.

In the prior art, clamps are bulky and high profile. The clamp head herein preferably has a low profile. It will be appreciated that, in some applications, the cutting tool will be cutting deeply into the work material in the vicinity of the clamp head 20. If the clamp head 20 is high profile—if it extends too far upward from the surface of the work material through which the cutting tool enters—then there is a substantial risk that the spindle carrying the cutting tool will contact clamp head 20, particularly on a deep cut. If this happens, then the spindle could be damaged. Also, this undesired contact could deflect or misposition the cutting tool, thus causing the cutting to be incorrectly done. In the prior art, there has not been success in creating a low profile clamp which also clamps consistently effectively, for example, for CNC machines.

In a preferred embodiment, the clamp head 20 has a profile of 2 centimeters or less above the work piece, when the clamp 16 is in use. In other words, the highest point of the clamp head 20 is 2 centimeters or less above the work surface of the workpiece, that is, the surface through which the cutting tool enters. In a more preferred embodiment, the profile is 1 cm or less. In a preferred embodiment, the profile of the frame 22 is less than or equal to the profile of the clamp head 20.

In the example clamp of FIGS. 2 and 3, the height adjustment assembly operates to adjust the height of the clamp 16 off of the wasteboard 12 by spacing the clamp 16 off of the wasteboard 12. It will be appreciated that height adjustment is useful because workpieces can be of different thicknesses. Therefore, effective clamping of a thicker workpiece may require a greater height for the clamp off of the wasteboard, while effective clamping of a thinner workpiece may require a lesser height for the clamp off of the wasteboard.

The height adjustment assembly comprises jack screw 24 and socket 26. The height is adjusted by adjusting the length of screw 24 outside of socket 26. The further the screw 24 is screwed into socket 26, the smaller the length, and the height. The less the screw 24 is screwed into socket 26, the greater the length, and the height. The head of screw 24 abuts wasteboard 12 to provide a point of contact for supporting clamp 16 at the desired height. The height adjustment function of the assembly is shown, for example, in FIG. 1. As can be seen, screw 24 is adjusted in height to position the clamp head 20 such that it can push down on work piece 10 to hold it in place.

Figure 4:
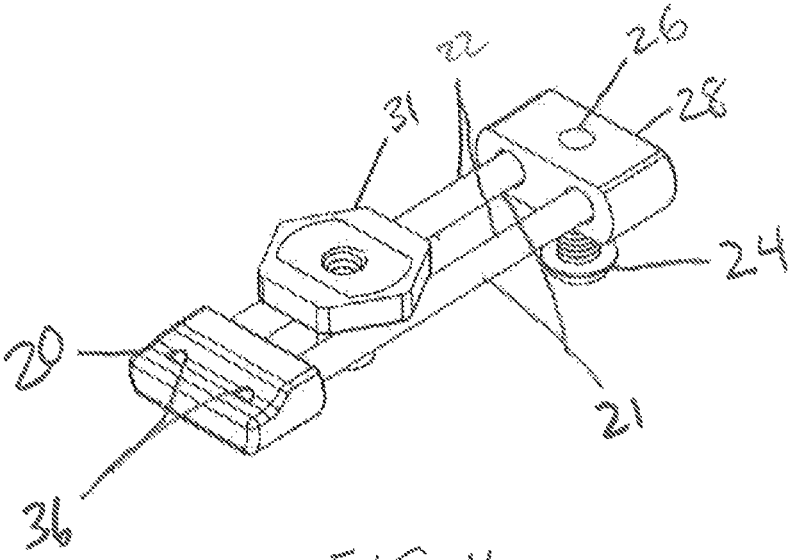
FIG. 4 is a perspective view of an embodiment of the clamp.

Referring now to FIG. 4, a version of clamp 16 is shown which operates with T-track wasteboards. The fixing element in this embodiment comprises nut 31, which screws onto a screw (not shown) extending upward from the T-track. Preferably, nut 31 is rotatable by hand, and by screwing nut 31 onto a screw extending from the T-track, the clamp 16 is fixed in position, and holds the workpiece in position. Preferably, nut 31 is selectively positionable, similar to socket 34. The reason is the same—t-tracks do not cover the entire wasteboard, and therefore there are a limited number of attachment positions. Therefore, it is beneficial to have adjustability.

Figure 5:
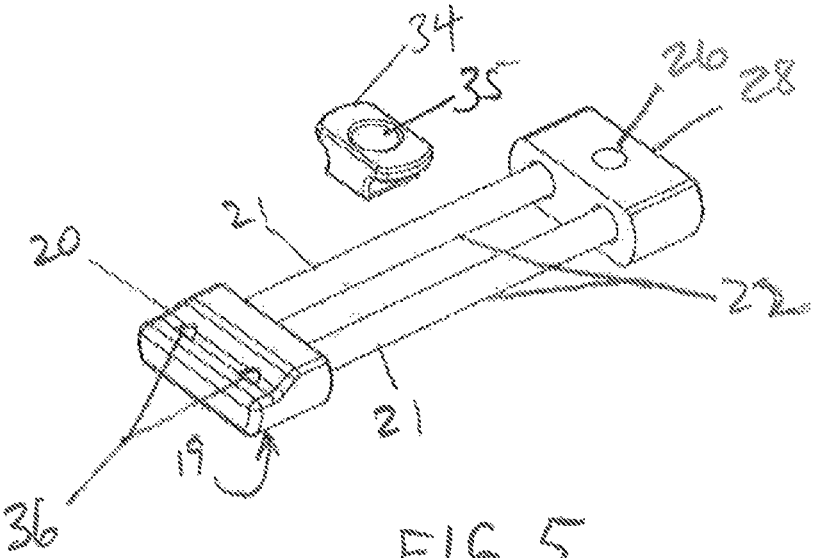
FIG. 5 is a perspective partially exploded view of an embodiment of the clamp.

FIG. 5 shows an exploded view of part of clamp 16, with the socket 34 shown apart from the frame 22.

Figure 7:
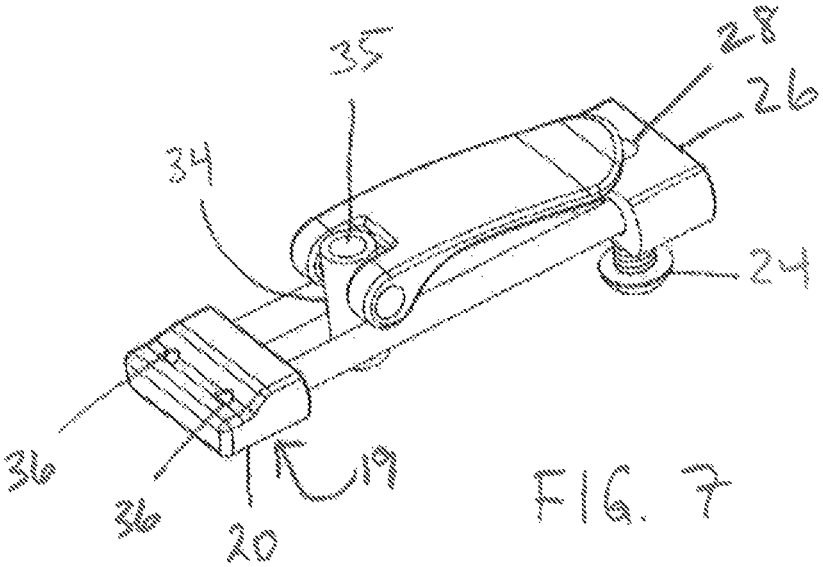
FIG. 7 is a perspective view of an embodiment of the clamp.

FIG. 7 shows an alternate embodiment of clamp 20. In this embodiment, configured for use with a t-track wasteboard, lever 38 is mounted to socket 34 and frame 22. Lever 38 is used to rotate socket 34 so as to cause it to screw onto a screw (not shown) attached to the t-track. This embodiment operates somewhat similarly to the embodiment of FIG. 4, but further includes lever 38 to make the rotation of socket 34, and connection to the t-track screw, easier. When not in use, lever 38 may be folded down on to clamp 16 to provide a low profile.

Figure 8:
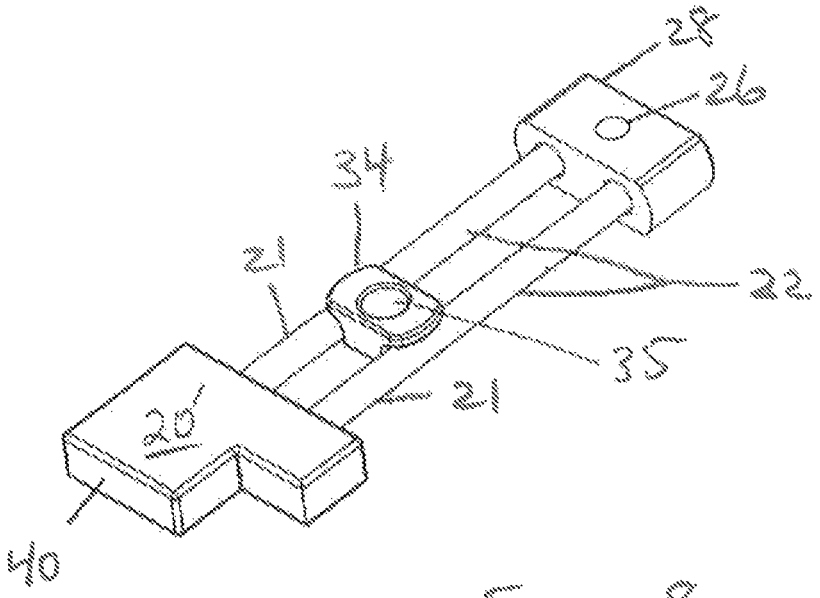
FIG. 8 is a perspective view of an embodiment of the clamp.

FIG. 8 shows an alternate embodiment of the invention. This embodiment includes a clamping head that abuts the corner of the workpiece, rather than the top surface of the workpiece, as the embodiment of FIG. 2 does. Thus, the clamping head 20' of FIG. 8 has a shape designed to receive a squared-off corner of a workpiece.

The embodiment of FIG. 8 could also be used to abut the side or edge of a workpiece, with the clamping surface 40 abutting that side or edge. In such a usage, the corner-receiving shape shown in FIG. 8 would not be required.

Figure 9:
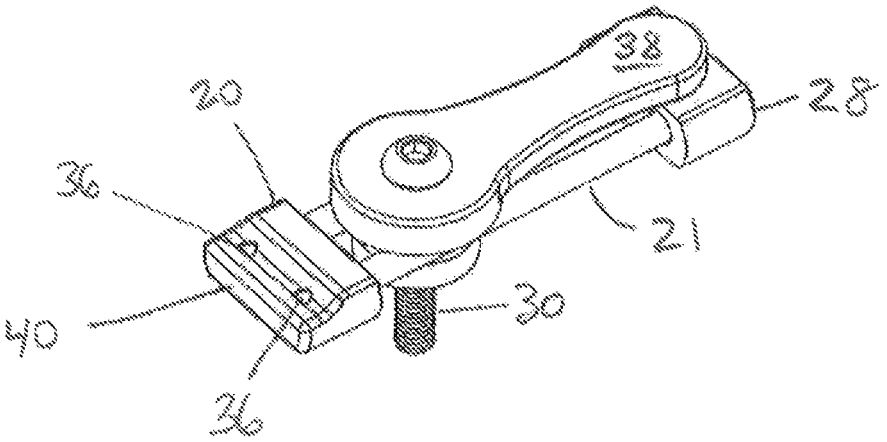
FIG. 9 is a perspective view of an embodiment of the clamp.

FIG. 9 shows an alternative embodiment of the clamp. Lever 38 is pivotally mounted to screw 30 and attached by screw 30 to the waste board. Lever 38 is rotatable relative to screw 30. Operatively connected to lever 38 is a force transmitter sized shaped and positioned to impart a force (generated by rotation of lever 38), to frame 22 to urge clamp 16 along the wasteboard. The clamp head 20 can thus be moved to force surface 40 to firmly abut a side or edge of the workpiece to hold it in place. The clamp can be loosened by rotation in the opposite direction. The force transmitter may comprise, for example, a gear or the like, mating with a gear or teeth or the like on pins 21 to facilitate the transmission of rotational force from lever 38 to clamp 16.

In the preferred embodiment, the clamp 16 is modular. Thus, the frame and clamp head can be used with different fixing elements. These would include screws (or any fixing element that operates with threaded insert wasteboards), hand nuts (or any fixing element that operates with t-track wasteboards), a top-positioned cam lever (as shown, for example, in FIG. 7), or a side cam lever. Thus, clamp may be provided in a kit that includes the frame, clamp head and two or more fixing elements, possibly including the aforementioned fixing elements.

While the foregoing preferred embodiments of the present invention have been set forth in considerable detail for the purpose of making a complete disclosure of the invention, it will be apparent to those skilled in the art that other embodiments described herein are comprehended by the broad scope of the invention as defined in the appended claims.

The above references to U.S. patents and patent publications in all sections of this application are herein incorporated by references in their entirety for all purposes. Components illustrated in such patents may be utilized with embodiments herein.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A clamp for use with a cutting machine, the clamp comprising:

a clamp frame comprises a pair of cylindrical pins, wherein the clamp frame having a length extending from a forward end portion to a rearward end portion;

a clamp head having a length extending from a front end to a rear end; the rear end operatively connected to the forward end portion of the clamp frame; and a fixing element, operatively connectable to the clamp frame between the pair of cylindrical pins, wherein the fixing element includes arcuate recesses engaging the cylindrical pins; the fixing element providing a clamping force to a work piece by fixing the clamp to a support base, the fixing element being positioned on the length between the forward and rearward end portions of the clamp frame, wherein the clamp head is a low profile clamp head sized and shaped to avoid contact with a cutting tool, the clamp head including an inclined profile between the front and rear ends and a lateral recess across the clamp head; wherein the clamp head is composed of plastic to prevent damage to cutting bits contacting the clamp head.

2. The clamp as claimed in claim 1, wherein the clamp frame comprises a frame stiffening element connecting the two pins, the clamp head forwardly extending from the forward end portion of the clamp frame.

3. The clamp as claimed in claim 1, wherein the fixing element comprises a screw, and the support base comprises a threaded insert wasteboard.

4. The clamp as claimed in claim 1, wherein the support base comprises a T-track wasteboard, and wherein the fixing element comprises a nut for attaching to a screw that is attached to the T-track wasteboard.

5. A clamp for use with a cutting machine, the clamp comprising:

a clamp frame comprises a pair of cylindrical pins, wherein the clamp frame having a length extending from a forward end portion to a rearward end portion;

a clamp head having a length extending from a front end to a rear end; the rear end operatively connected to the forward end portion of the clamp frame; and a fixing element, operatively connectable to the clamp frame between the pair of cylindrical pins, wherein the fixing element includes a lever operatively coupled to the fixing element for actuating the fixing element; the fixing element providing a clamping force to a work piece by fixing the clamp to a support base, wherein the clamp head is operatively attachable to and detachable from the forward end portion of the clamp frame solely by hand by grasping the clamp head and moving the clamp head onto the forward end portion to an attached position and by grasping the clamp head and moving the clamp head apart from the forward end portion to a detached position;

wherein the clamp head is a low profile clamp head sized and shaped to avoid contact with a cutting tool, the clamp head including an inclined profile between the front and rear ends and a lateral recess across the clamp head.

6. The clamp as claimed in claim 5, wherein the clamp head is slidable on to and off of the pins and forwardly extends from the forward end portion of the clamp frame.

7. The clamp as claimed in claim 5, wherein the clamp head is composed of plastic.

8. A clamp kit comprising:

the clamp of claim 5; and a second clamp head, operatively connectable to the clamp frame, for replacing said clamp head.

9. The clamp kit as claimed in 5, wherein said fixing element operates with threaded insert wasteboards, the kit further comprising a second fixing element which operates with T-track wasteboards.

10. A clamp for use with a cutting machine having a spindle that carries a cutting tool, the clamp comprising:

a clamp frame comprises a pair of cylindrical pins;

a clamp head having a length extending from a front end to a rear end; the rear end operatively connected to the clamp frame, the clamp head having a clamping surface for pressing on a work piece to hold said work piece; and a fixing element, operatively connectable to the clamp frame between the pair of cylindrical pins, wherein the fixing element includes arcuate recesses engaging the cylindrical pins; the fixing element providing a clamping force to the clamp head by fixing the clamp to a support base for the work piece, wherein the clamp head is a low profile clamp head sized and shaped to avoid contact with the spindle any time the spindle is positioned two centimeters or more from a work surface of the work piece; wherein the clamp head includes an inclined profile between the front and rear ends and a lateral recess across the clamp head.

11. The clamp as claimed in claim 10, the clamp frame having a length extending from a forward end portion to a rearward end portion, wherein the clamp head is operatively connected to and forwardly extends from the forward end portion of the clamp frame, and the fixing element being positioned on the length between the forward and rearward end portions of the clamp frame, wherein the pair of cylindrical pins extending from the forward end portion to the rearward end portion, and a frame stiffening element connecting the two pins and being positioned at the rearward end portion, rearward of the fixing element.

12. The clamp as claimed in claim 10, wherein the clamp head extends less than 1 centimeter above the work surface.

13. The clamp as claimed in claim 10, wherein the clamp frame has a profile no higher than the clamp head.

14. The clamp as claimed in claim 12, wherein the clamp frame has a profile no higher than the clamp head.

15. The clamp as claimed in claim 1, wherein the clamp head is operatively connected to and forwardly extends from the forward end portion of the clamp frame, and the fixing element being positioned on the length between the forward and rearward end portions of the clamp frame, wherein the clamp frame comprises a frame stiffening element connecting the two pins and being positioned at the rearward end portion, rearward of the fixing element.

16. The clamp as claimed in claim 15, the fixing element being movable and adjustably positioned on the length relative to and between the forward and rearward end portions of the clamp frame.

17. The clamp as claimed in claim 5, wherein the clamp head operatively connected to the forward end portion of the clamp frame and wherein the clamp head is operatively attachable to and detachable from the forward end portion of the clamp frame by hand by grasping the clamp head and pushing the clamp head onto the forward end portion in a rearward direction to an attached positioned and by grasping the clamp head and pulling the clamp head apart from the forward end portion in a forward direction to an detached positioned, the fixing element being positioned on the length between the forward and rearward end portions of the clamp frame.

18. The clamp as claimed in claim 17, the fixing element being movable and adjustably positioned on the length relative to and between the forward and rearward end portions of the clamp frame.

19. The clamp as claimed in claim 11, the fixing element being movable and adjustably positioned on the length relative to and between the forward and rearward end portions of the clamp frame.

* * * * *